US006165064A

United States Patent [19]

Aurelius et al.

[11] Patent Number: 6,165,064

[45] Date of Patent: Dec. 26, 2000

[54] COIN MECHANISM WITH CASHBOX ARRANGED ABOVE COIN DISPENSING MEANS

[75] Inventors: Karen Aurelius, Nr. Wokingham, United Kingdom; Sven Tobben, Dusseldorf, Germany

[73] Assignee: Mars, Incorporated, McLean, Va.

[21] Appl. No.: 09/209,510

[22] Filed: Dec. 10, 1998

[30] Foreign Application Priority Data

Dec. 18, 1997 [GB] United Kingdom ..... 9726861

[51] Int. Cl.[7] ..... G07D 3/00

[52] U.S. Cl. ..... 453/18

[58] Field of Search ..... 453/3, 4, 5, 7, 453/9, 11, 14, 15, 17, 18

[56] References Cited

U.S. PATENT DOCUMENTS

| | | | |
|---|---|---|---|
| 1,076,584 | 10/1913 | Kohler | 453/3 |
| 4,374,529 | 2/1983 | Kobayashi et al. . | |
| 4,669,393 | 6/1987 | Wuthrich . | |
| 4,836,825 | 6/1989 | Smeets et al. . | |
| 5,021,026 | 6/1991 | Goi . | |
| 5,052,538 | 10/1991 | Satoh . | |
| 5,056,643 | 10/1991 | Kirberg | 194/202 |
| 5,082,100 | 1/1992 | Guyonneau . | |
| 5,400,891 | 3/1995 | Winstanley | 194/350 |
| 5,468,181 | 11/1995 | Ishida et al. | 453/3 |
| 5,501,633 | 3/1996 | Watkins et al. | 453/17 |

FOREIGN PATENT DOCUMENTS

| | | |
|---|---|---|
| 808991 | 3/1969 | Canada . |
| 0 326 051 A2 | 8/1989 | European Pat. Off. . |
| 0 351 295 A1 | 1/1990 | European Pat. Off. . |
| 0 355 238 A1 | 2/1990 | European Pat. Off. . |
| 0 450 927 A1 | 10/1991 | European Pat. Off. . |
| 0 575 136 A1 | 12/1993 | European Pat. Off. . |
| 1 317 326 | 12/1961 | France . |
| 2 359 469 | 2/1978 | France . |
| 2 065 950 | 7/1981 | United Kingdom . |
| 2 130 299 | 5/1984 | United Kingdom . |
| 2 140 187 | 11/1984 | United Kingdom . |
| 2 284 090 | 5/1995 | United Kingdom . |

*Primary Examiner*—Dean J. Kramer
*Assistant Examiner*—Bryan Jaketic
*Attorney, Agent, or Firm*—Fish & Richardson P.C.

[57] ABSTRACT

A coin mechanism includes a cashbox which is arranged above the coin dispensers of the coin mechanism.

22 Claims, 7 Drawing Sheets

COIN MECHANISM WITH CASHBOX ARRANGED ABOVE COIN DISPENSING MEANS

BACKGROUND

The invention relates to coin mechanisms, especially for use in vending machines and the like, and to a removable and replaceable cassette for storing and dispensing coins for use in such mechanisms.

In known coin-operated vending machines, a coin mechanism is provided for receiving and testing the acceptability of inserted coins. Acceptable coins are diverted either to one of a plurality of coin storage tubes, each for storing and dispensing in change coins of a respective denomination, or, if no coin tube is provided for a particular denomination because that denomination is not needed for change, or if the relevant tube is full, to a separate cashbox. The cashbox is situated remote from the coin mechanism, within the vending machine, but connected to it by a passageway. Coins are collected periodically from the cashbox by a serviceman. The coin storage tubes may be arranged within a cassette which is removable from and replaceable in the coin testing mechanism, as described, for example, in GB-A-2 246 897.

The arrangement including a coin mechanism with coin storage tubes and a cash box described above takes up a relatively large amount of space in a vending machine. For that reason, it is usual in smaller vending machines such as those designed to sit on tabletops (for example, coffee machines for use in offices) to have a cashbox but no coin storage tubes. The main disadvantage of such machines is that they are not capable of giving change and thus, if the potential customer does not have the correct change for a transaction, a sale may be lost.

SUMMARY

The present invention provides a coin mechanism comprising coin dispensing means and a cashbox arranged in use above the coin dispensing means. For example, the cashbox can be installed in space in a coin mechanism normally occupied by dispensing tubes, or adjacent to dispensing tubes. As a result, a coin mechanism can be made more compact than known machines with similar functions. Also, by putting a cashbox above the dispensing means, the cashbox can be emptied using the dispensing means.

The invention also provides a cassette, for use in a coin mechanism, which is removable from and replaceable in the coin mechanism, wherein the cassette comprises a cashbox.

The invention also provides a coin mechanism comprising a coin reject path and a cashbox, wherein coins can be removed from the cashbox by way of the coin reject path. The invention also provides a coin mechanism comprising a coin return tray and a cashbox, wherein coins can be removed from the cashbox by way of the coin return tray. As a result, it can be easier to collect coins from the cashbox.

The invention further provides a method of assembling a coin mechanism comprising selecting either a cashbox or one or more alternative stores fittable in a predetermined location.

The invention further provides a method of adapting a coin mechanism or a cassette for use in a coin mechanism including single denomination stores for dispensing coins, the method comprising replacing one or more of said stores with a cashbox.

The invention further provides a method of assembling a coin storage device suitable for attachment as a unit to a coin mechanism and comprising a housing, the method comprising attaching a cashbox to the housing.

BRIEF DESCRIPTION OF THE DRAWING

Embodiments of the present invention are described below with reference to the accompanying drawings, of which.

DETAILED DESCRIPTION

A first embodiment of the invention will be described with reference to FIGS. 1, 2 and 3.

Figure 1:
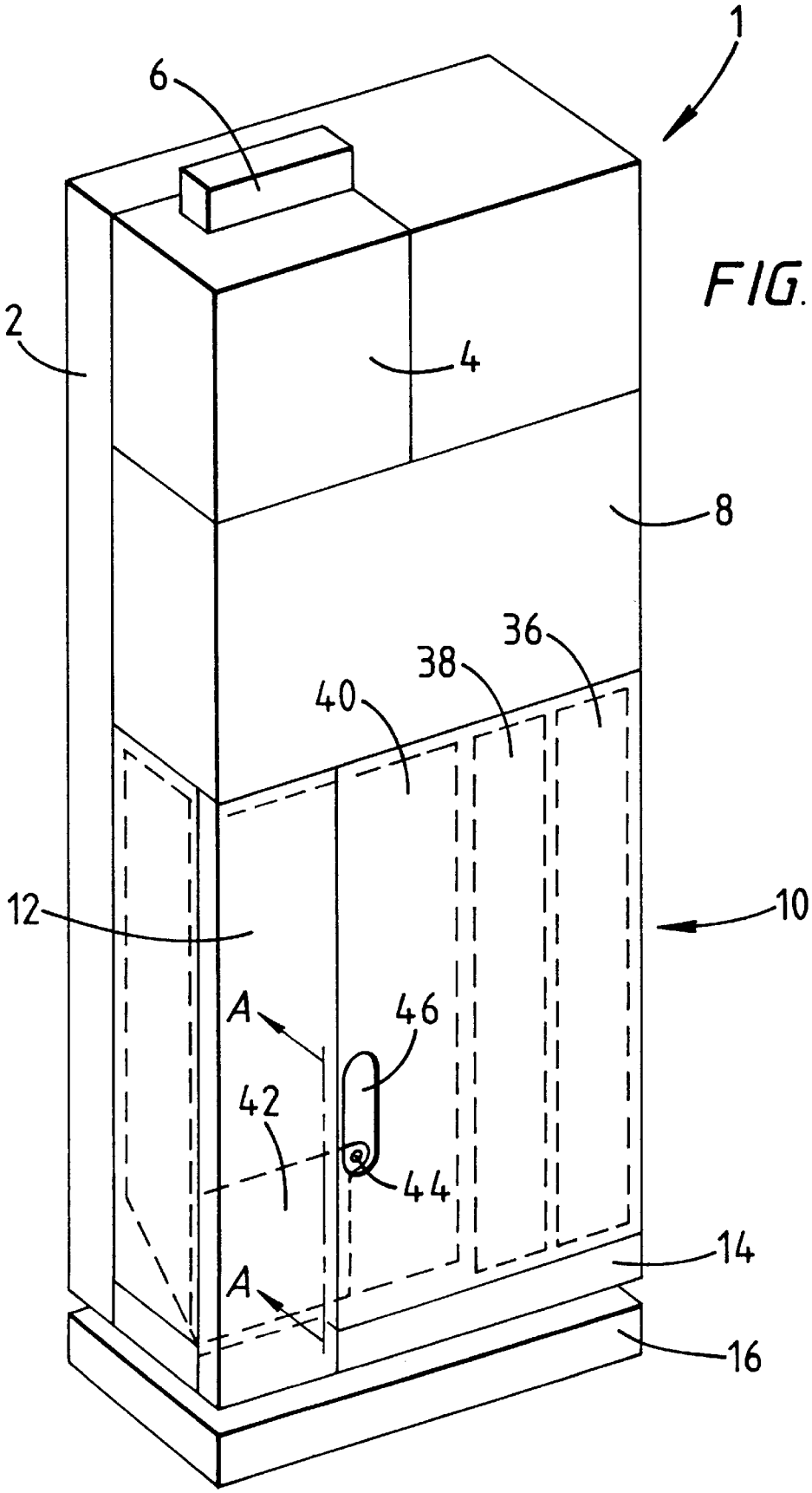
FIG. 1 is a perspective view of a coin mechanism.

FIG. 1 shows a coin mechanism, indicated generally by the reference numeral 1, for use in a vending machine (not shown). The coin mechanism includes a mainframe 2 supporting a coin validator 4 for testing the validity of coins inserted through a coin inlet 6 and a coin separator 8 for routing the inserted coins according to the outcome of the validity test.

The coin separator is connected to a coin storage section, indicated generally by the reference numeral 10, and to a coin reject passageway 12 extending along the front left hand corner of the coin storage section. Below the coin storage section 10, there is a coin dispensing section 14, for dispensing coins as change from the coin storage section. A coin return tray 16 is arranged below the coin mechanism 1 for receiving coins from the reject passageway 12 or coins dispensed from the coin storage section 10, to be collected, for example, by a customer.

Figure 2:
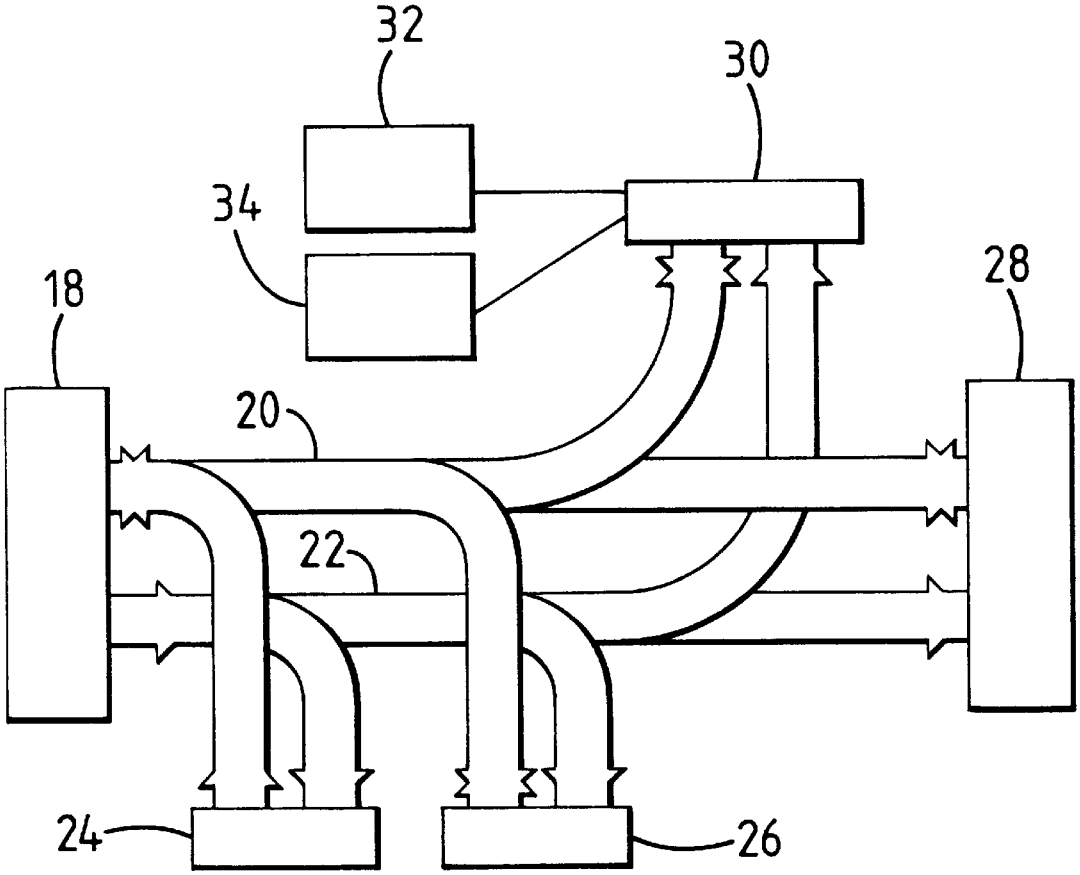
FIG. 2 is a block diagram of the circuit of the mechanism.
Figure 3:
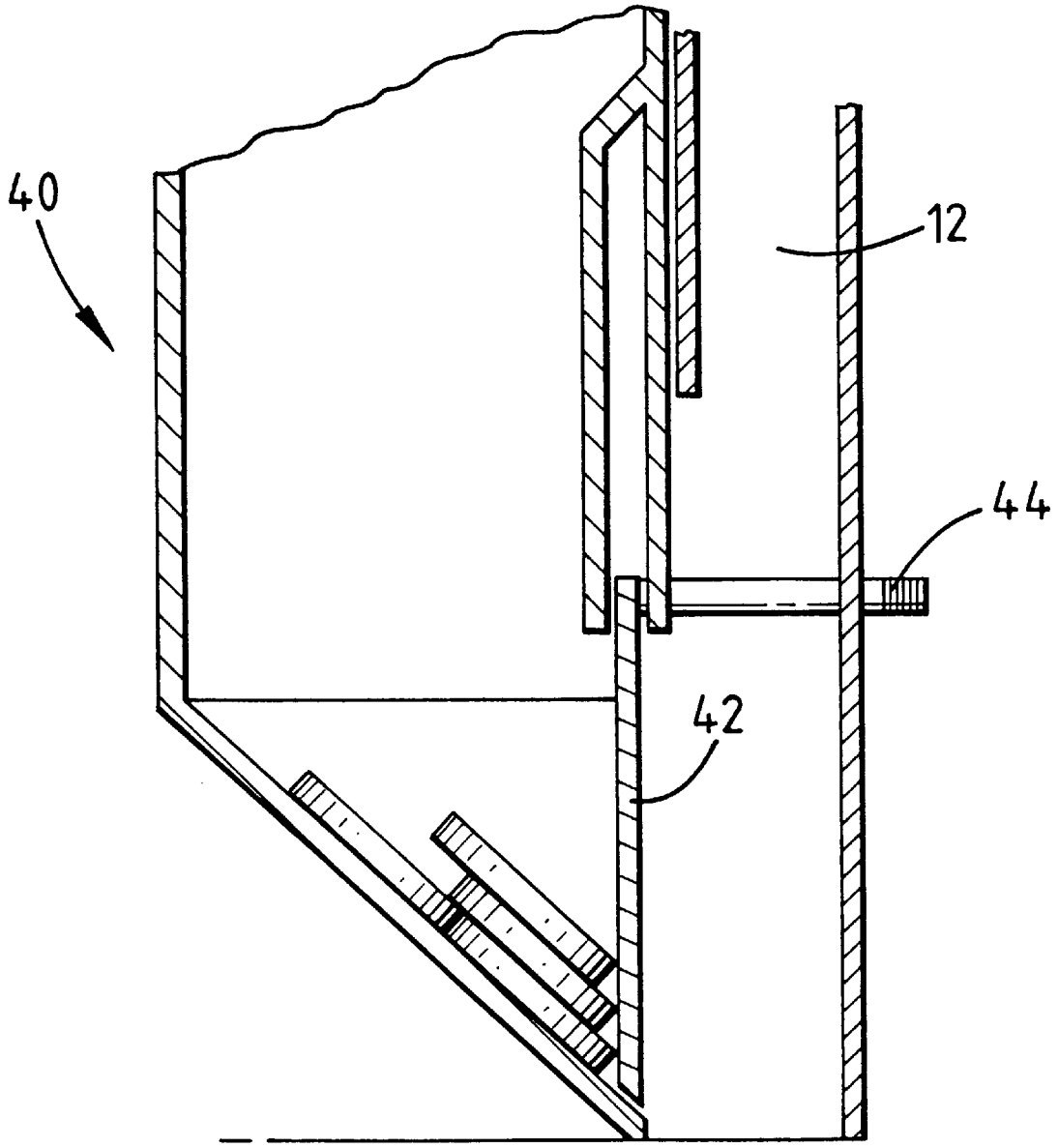
FIG. 3 is a cross-section along the line A—A of FIG. 1.

Referring to FIG. 2, the circuit of the present embodiment of the invention incorporates a microprocessor 18 connected to data and address buses 20 and 22. Although separate buses are shown, data and address signals could instead be multiplexed on a single bus. A bus for control signals could also be provided.

The microprocessor 18 is connected via the buses 20 and 22 to a read-only memory (ROM) 24 and a random access memory (RAM) 26. The ROM 24 stores the program controlling the overall operation of the microprocessor 18, and the RAM 26 is used by the microprocessor 18 as a scratch-pad memory.

The microprocessor 18, the ROM 24 and the RAM 26 are, in the preferred embodiment, combined on a single integrated circuit.

The microprocessor 18 may also be connected via the buses 20 and 22 to an EAROM (Electrically Alterable Read Only Memory) 28 for storing a variety of alterable parameters.

The microprocessor 18 is also coupled via the buses 20 and 22 to input/output circuitry indicated at 30. The circuitry 30 includes user-operable switches, circuits for operating the dispenser 16 and the gates of the coin separator 8, the circuitry of the coin validator 4, and a display visible to a user of the apparatus for displaying an accumulated credit value and an indication when insufficient coins are stored to guarantee that change will be available.

The input/output circuitry 30 also includes an interface between the control circuit of the apparatus and a vending machine 32 to which it is connected, and a further interface to an audit device 34.

In operation of the apparatus the microprocessor 18 successively tests the signals from the validator to determine whether a coin has been inserted in the apparatus. When a credit has been accumulated, the microprocessor also tests signals from the vending machine to determine whether a vending operation has been carried out. In response to various signals received by the microprocessor 18, various parts of the program stored in the ROM 24 are carried out. The microprocessor is thus arranged to control the gates in the separator 8 in order to deliver the coins to the required locations, and is also operable to cause appropriate information to be shown on the displays of the apparatus and to deliver signals to the vending machine to permit or prevent vending operations. The microprocessor is also operable to control the dispenser to deliver appropriate amounts of change. The audit device 34 maintains a record of the number of coins of each denomination received and dispensed by the apparatus.

The arrangement so far is quite conventional, and the details of particular structures suitable for using as various parts of the mechanism will therefore not be described in detail.

The particular sequence of most of the operations carried out by the microprocessor may be the same as in previous apparatus. A suitable program to be stored in the ROM 24 can therefore be designed by anyone familiar with the art.

The coin storage section 10 comprises two coin storage tubes 36, 38 and a cashbox 40, as shown in outline in FIG. 1.

The coin storage tubes 36, 38 are arranged side by side in the right half of the coin storage section 10 and extend between the coin separator 8 and the coin dispensing section 14, and are open at both ends. Coins enter the coin storage tubes 36, 38 at one end from the coin separator 8, are stored within the tubes in a stack face to face and are dispensed from the tubes at the other end. Associated with each coin storage tube are pairs of coin level sensors (not shown) for detecting when the stack of coins within a tube exceeds a first, higher, level or is below a second, lower, level.

The cashbox 40 is arranged in the left half of the coin storage section 10, partially behind the reject passageway 12, and it extends between the coin separator 8 and the coin dispensing section 14. The cashbox 40 has four walls, a base, and is open at the top, to receive coins from the separator 8. The width of the cashbox 40 is approximately twice that of each of the coin storage tubes 36, 38. The base of the cashbox 40 is inclined downwardly towards the front, as shown in FIG. 3. At the lower end of the front wall of the cashbox there is a slidable door 42, which is behind and approximately the same width as the reject passageway 12. The door 42 is slidable up and down using a handle 44 which extends through and is movable within a slot 46 in the front wall of the coin storage section 10 next to the reject passageway 12. When the door 42 is open, the cashbox 40 opens into the reject passageway 12.

The cashbox 40 and the coin storage tubes 36, 38 are made of moulded plastics material.

The coin dispensing section 14 comprises two dispensers, each arranged underneath a respective coin storage tube 36, 38.

The coin mechanism 1 is configured to determine which denominations of coins are acceptable, and of those acceptable denominations, which denominations are to be directed to the cashbox 40 and which denominations to the coin storage tubes 36, 38 to be used for change. In this example, the coin mechanism accepts 5p, 10p, 20p, 50p and £1 coins. 5p coins are to be stored in the first coin storage tube 36, 10p coins are to be stored in the second coin storage tube 38 and the other acceptable denominations are to be stored in the cashbox 40.

In operation, a coin inserted into the coin inlet 6 rolls into the validator 4 and is subjected there to various tests to determine if it is a coin of a denomination deemed acceptable by the mechanism, in accordance with known techniques. If the coin is an acceptable coin it is directed by a gate within the coin validator 4 to the coin separator 8 which includes gates which are operated according to the outcome of the tests in the validator to determine the subsequent path of the coin, as is known. If the coin is not an acceptable coin, it is directed by the gate within the coin validator 4 to the coin reject passageway 12, which leads outside the coin storage section 10 and the dispensing section 14 to the coin return tray 16. If the coin is one of the denominations for which a coin storage tube 36, 38 is provided, in this case, a 5p or a 10p, then the separator 8 directs the coin to the relevant tube. If the relevant tube is full, or if the coin is one of the other acceptable denominations, then the separator 8 directs the coin along a path (or one of a plurality of paths) that leads to the cashbox 40. In a known manner, when a coin of a given denomination is needed for change, the dispensers 14 remove a single coin from the bottom of the stack of coins within the tube 36, 38 and then release the coin so it drops through a hole in the base of the dispensing section 14 into the coin return tray 16.

Over time, coins accumulate within the cashbox 40, because coins are not dispensed as change from it. As shown, the coins in the cashbox are not stored in an ordered manner, such as a stack as in the coin tubes, but in a disordered fashion. Periodically, a serviceman visits the mechanism to empty the cashbox 40. This is done by moving the handle 44 upwards, which causes the door 42 of the cashbox 40 to open. Because the base of the cashbox 40 is inclined downwardly towards the door 42, coins slide from the cashbox into the reject passageway 12 and thence to the coin return tray 16. The coins are collected from the coin return tray 16.

Figure 4:
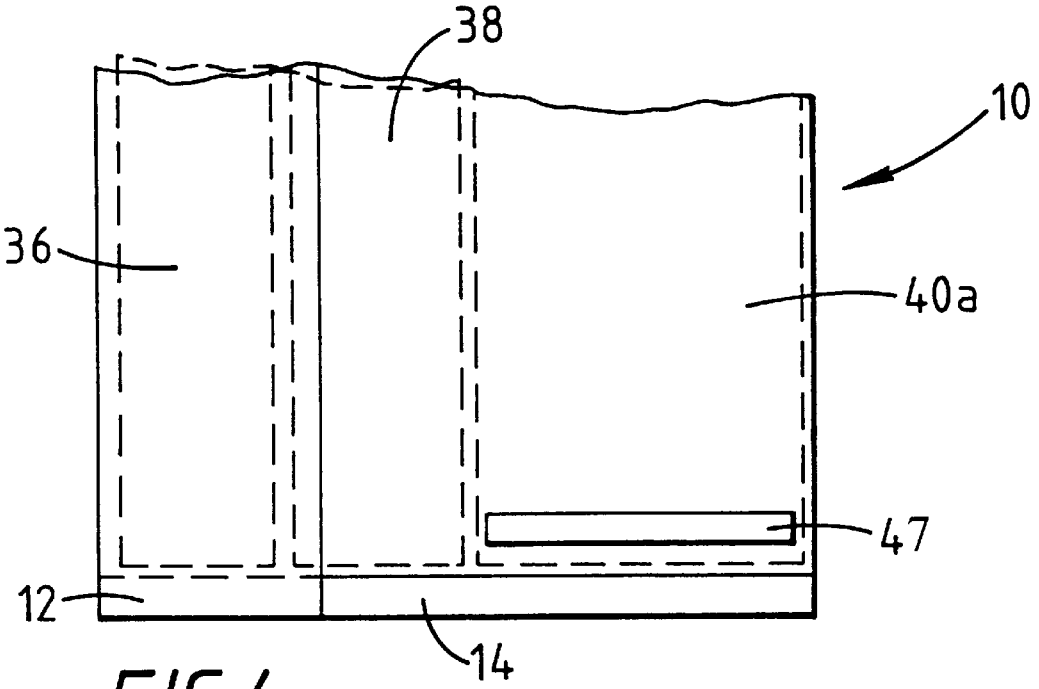
FIG. 4 is a front view of part of a second coin mechanism.
Figure 5:
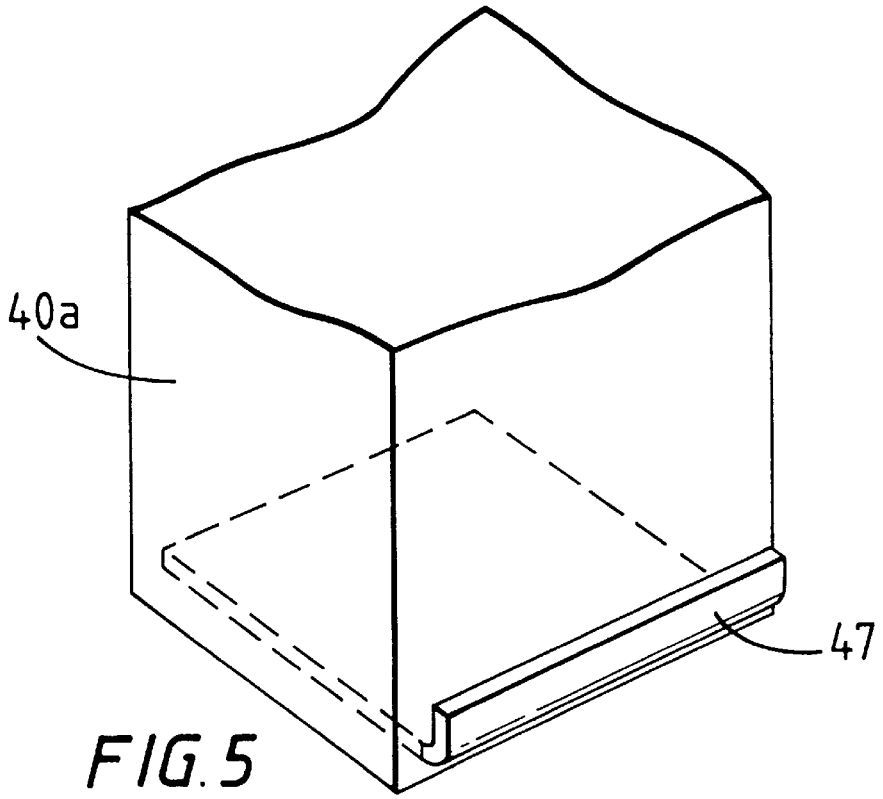
FIG. 5 is a perspective view of a cashbox.

In an alternative embodiment, shown in FIGS. 4 and 5, the cashbox 40*a* is arranged in the right side of the coin storage section 10, away from the coin reject passageway 12. The two coin tubes 36, 38 with their associated dispensers are arranged in the left side of the coin storage section 10. As shown in FIG. 5, the base of the cashbox 40*a* is in the form of a slidable tray 47, which extends through the front of the coin storage section 10 so that one end can be grasped from outside to move it. Underneath the cashbox 40, there is a space (not shown) through the dispensing section 14, so that when the tray 47 is pulled out to open the base of the cashbox 40*a*, coins drop straight from the cashbox 40*a* into the coin return tray 16 and can be collected as above. Alternatively, chutes may be arranged below the cashbox 40*a*, which connect to the reject route 12, so that coins emptied from the cashbox 40*a*, when the base of the cashbox is open, are directed to the reject route, or to any other suitable path to allow the coins to be collected.

At least part of the front of the housing in the coin storage section may be removable, or provided with a door, so that at least part of the cashbox is exposed. In that case, the cashbox may have a hinged door on its front wall allowing the coins in the cashbox to be removed. Alternatively, all of the front of the housing in the coin storage section may be removable, to expose the cashbox and the coin storage tubes. The cashbox may be so mounted that it can be removed from the housing and can be emptied simply by turning it upside down. Especially if the storage tubes are also removably mounted, the cashbox can be replaced with a different cashbox, for example, one of a different shape and size. For example, the cashbox in the example given above could be replaced with a larger cashbox, occupying space equivalent to that of three coin storage tubes, and with one coin storage tube provided for change instead of two. Alternatively, a cashbox may take up all the space within the coin storage area, with no coin storage tubes provided. If the stores within the coin mechanism are changed, corresponding alterations to the routing and dispensing of coins may be necessary.

Figure 6:
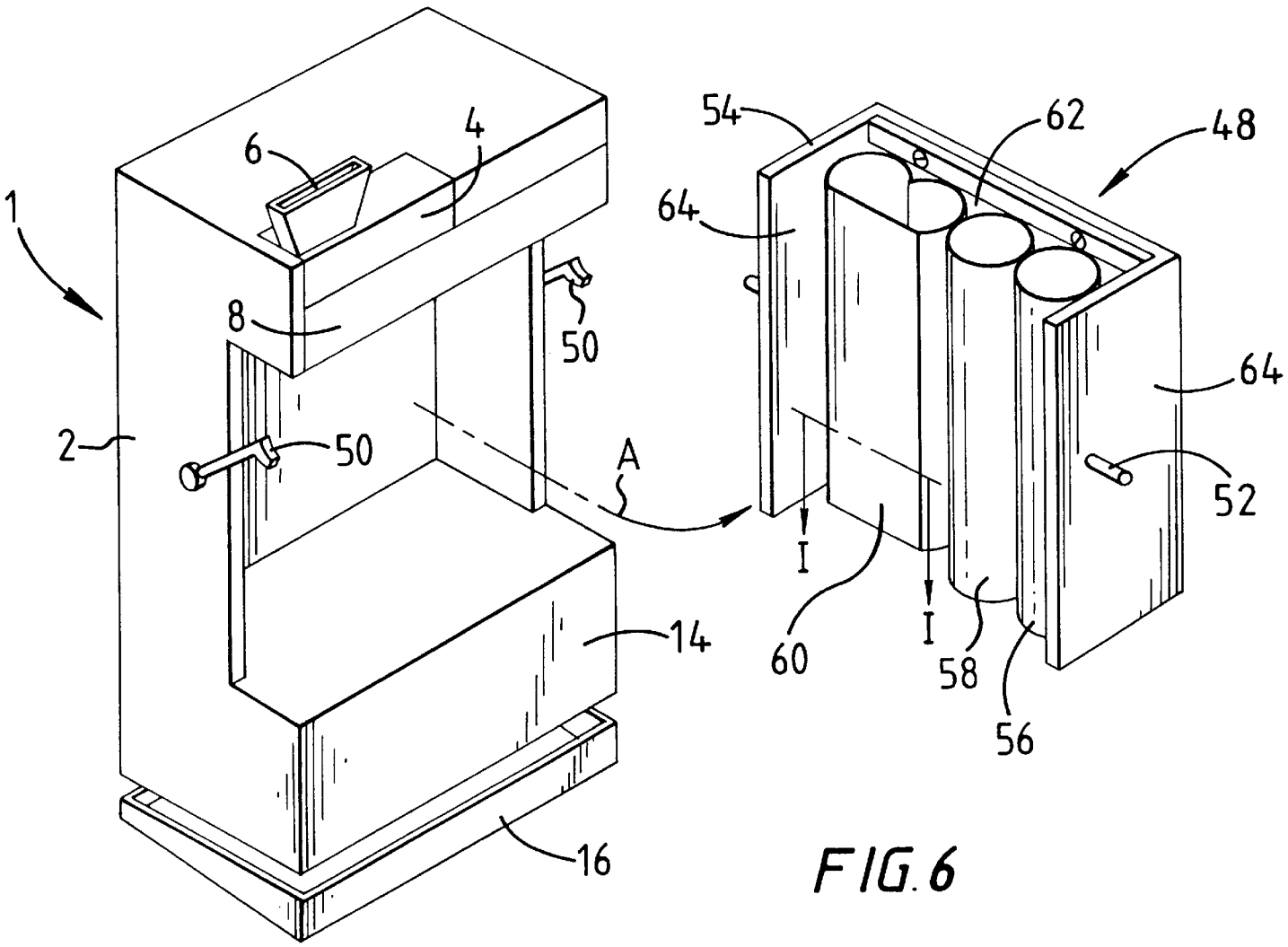
FIG. 6 is a perspective view of a third coin mechanism including a removable cassette.

FIG. 6 shows a further embodiment of the invention. In this embodiment, the coin mechanism corresponds to that of the first embodiment except that coin stores, in the form of two coin storage tubes and a cashbox, are provided within a removable cassette, indicated generally by the reference numeral 48, rather than being attached directly to the body of the coin mechanism.

The cassette 48 is mounted in a recess in the coin mechanism where hooks 50 on the mainframe engage pegs 52 on the cassette 48 to hold it in position.

Figure 7:
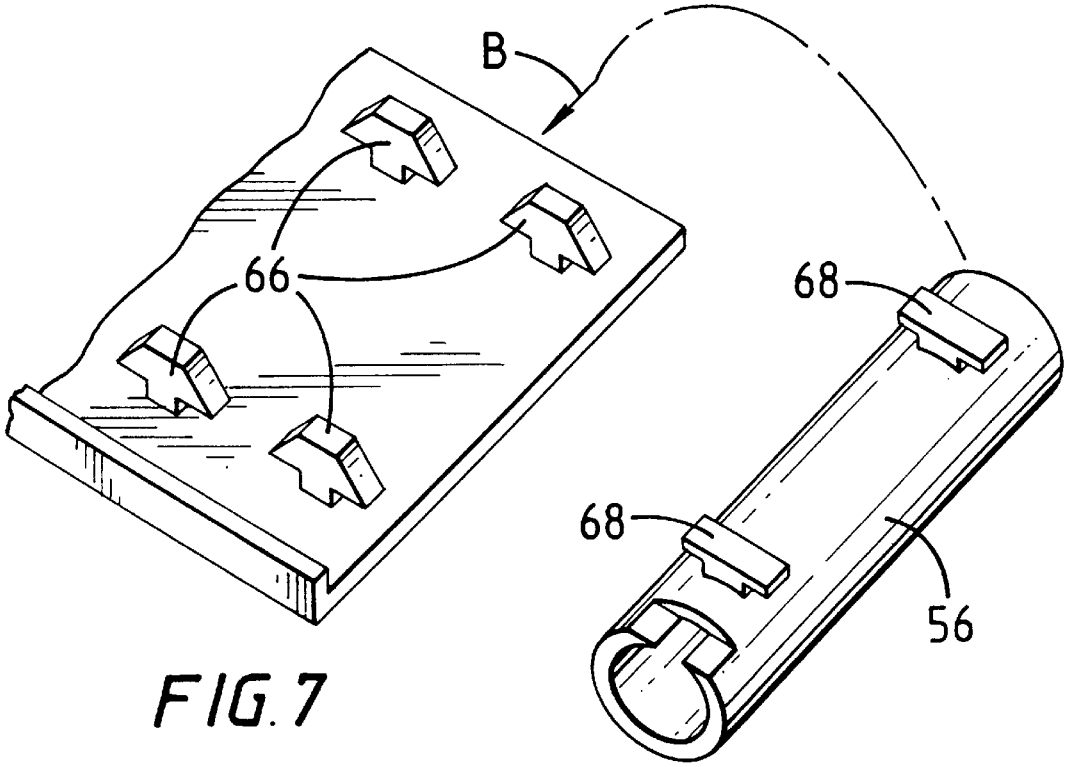
FIG. 7 is a view showing part of the cassette of FIG. 6.

In more detail, the removable cassette 48 comprises a support 54 on which are removably mounted coin stores in the form of two coin storage tubes 56, 58 and a cashbox 60. The support 54, the coin storage tubes 56, 58 and the means of mounting the tubes on the support are known, for example, from GB 2 246 897, the contents of which document are incorporated herein by reference. Briefly, the support 54 is generally channel-shaped with a front wall 62 and two side walls 64. On the inside of the front wall 62 are retaining means in the form of pairs of T-shaped projections 66 (see FIGS. 7 and 9). With reference to FIG. 7, each coin storage tube 56, 58 is provided with bars 68 which are made to engage respective pairs of T-shaped projections 66 on the support 54 when the tube is pushed into position in the direction indicated by arrow B, to mount the tube in a predetermined position. The components are dimensioned so that the retaining means are an interference fit and some manual force is required to push the tube in the direction of arrow B.

Figure 8:
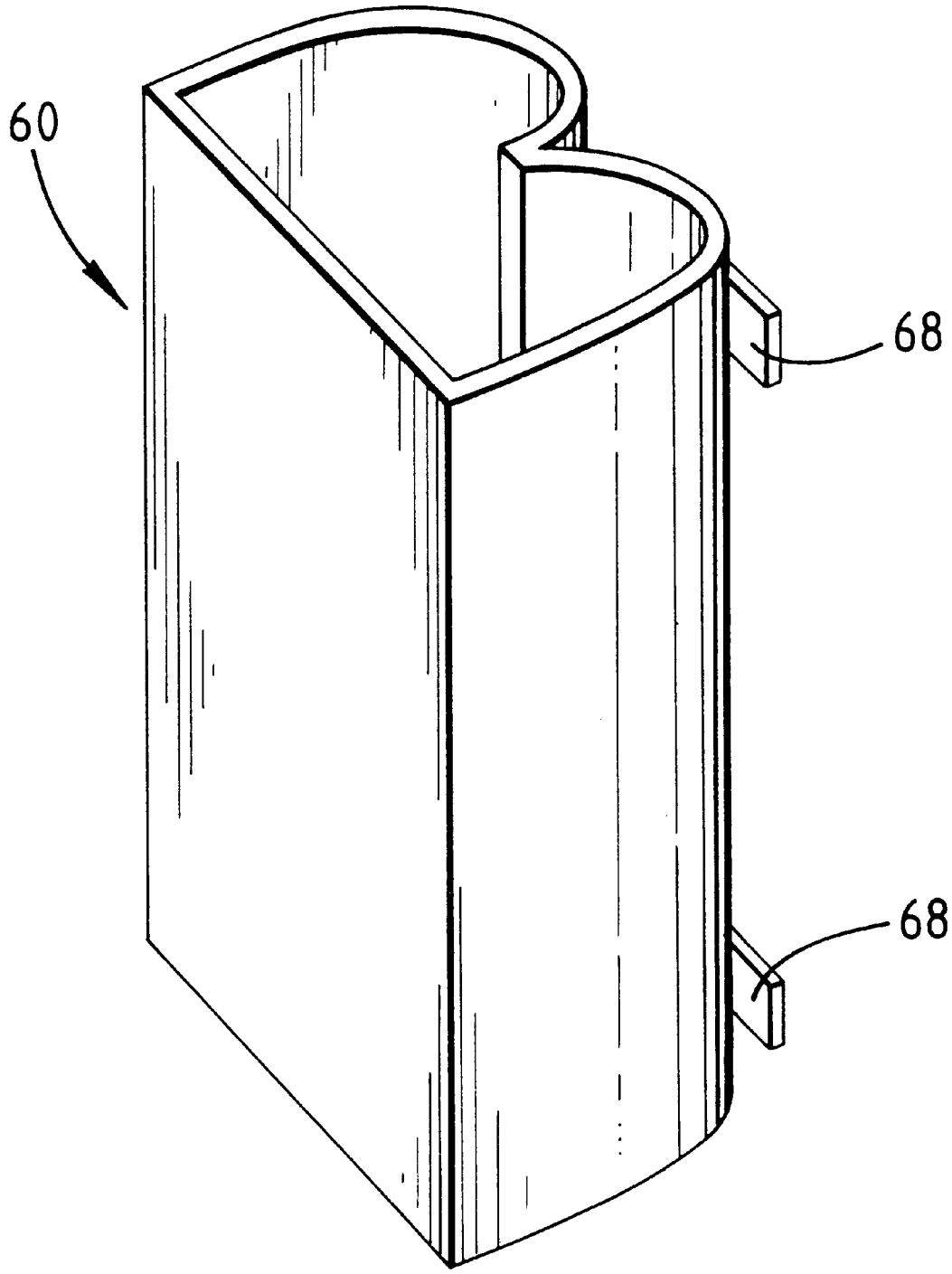
FIG. 8 is a perspective view of the cashbox shown in FIG. 6.

The cashbox 60 is shown in more detail in FIG. 8. The front part of the cashbox 60 is shaped so as to be similar to the front of two coin storage tubes side by side. More specifically, the front part of the cashbox 60 is shaped like two adjoining half-cylinders. The sides of the half-cylinders extend to the back part of the cashbox which is flat. The top of the cashbox 60 is open but the bottom is closed. The height of the cashbox 60 is the same as the height of each coin storage tube 56, 58 in the cassette 48.

Figure 9:
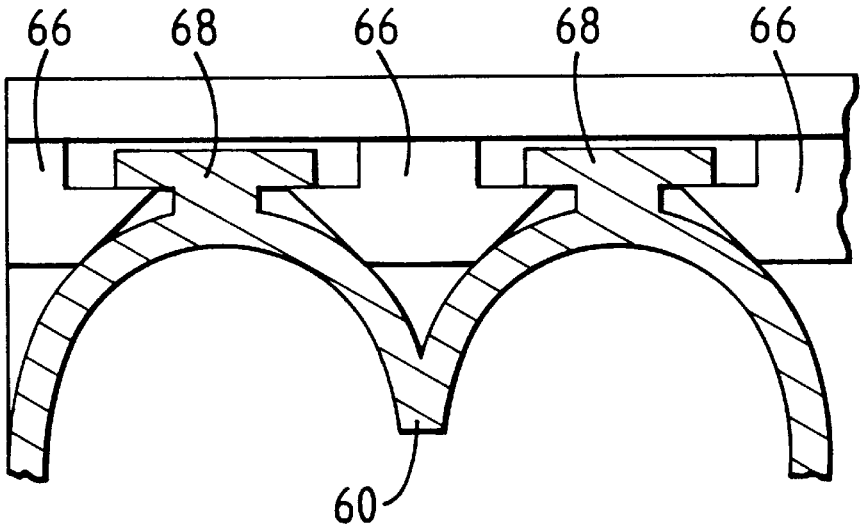
FIG. 9 is a cross-section along line I—I of FIG. 6.

Each half-cylinder of the front part of the cashbox 60 is also provided with a pair of bars 68 for mounting the cashbox on the support 54 in the same way in which the coin storage tubes 56, 58 are mounted. With reference to FIG. 9, which shows the cashbox 60 mounted on the support 54 in cross-section, the bars 68 engage T-shaped projections 66 on the support 54 to retain the cashbox 60 in a predetermined position.

As before, in operation, the coin validator 4 tests coins and the coin separator 8 routes acceptable coins according to their denomination determined by the testing section either to a respective coin storage tube 56, 58 for receiving one particular denomination or to the cashbox 60 if the proper coin storage tube is full or if the coin denomination involved is not one which is intended to be dispensed. Coins are dispensed as change from the bottom of the tubes. Coins are not dispensed as change from the cashbox 60.

To empty the cashbox 60, the serviceman removes the cassette 48 from the coin mechanism 1, then lifts the cashbox out of the cassette and turns the cashbox upside down to tip out the coins.

The design of the cashbox 60, the tubes 56, 58 and the support 54, including the bars 68 and the projections 66, are such that the tubes 56, 58 can be interchanged, and the two tubes can be interchanged with the cashbox 60, so that various configurations of the cassette are possible. Also, the tubes 56, 58 and/or the cashbox 60 can be interchanged with other tubes, for example, for storing coins of other denominations, or other cashboxes. Thus, for example, the mechanism can be converted from one having entirely coin storage tubes to one having coin storage tubes and a cashbox and vice versa. It may be desirable in some circumstances to have a cashbox and no tubes, in which case the cashbox may take up the entire cassette. When the cassette of an existing coin mechanism is altered in any of the above ways, the serviceman reconfigures the coin mechanism to ensure that coins are correctly routed to the right store by inserting an appropriate code indicating the position of the various stores using a keypad (not shown) on the mechanism.

Various modifications to the second embodiment are possible.

For example, the stores (including the cashbox) need not be removable from the cassette, in which case it is necessary to replace the cassette to change the configuration of the coin stores. The cassette and stores may be integrally moulded.

The cashbox may include a means to allow it to be emptied while it is upright, for example, a door on a side of the cashbox which is accessible, for example, when the cassette is removed from the coin mechanism. The cassette housing may include a hinged opening to provide access to the cashbox from the outside of the coin mechanism without needing to remove the cassette. The cashbox can then still be emptied even if it is difficult or impossible to remove the cassette, for example, if the cassette is screwed in place. The cashbox can also be emptied by covering any top openings of the other stores and turning over the entire cassette to tip out the coins in the cashbox.

In either embodiment, a store (whether a cashbox or other store) may be interchangeable with another store. Although it is easier, for example, to fit the cashbox into an existing cassette if it is shaped like a tube, the cashbox can be any suitable shape, preferably one which maximises the capacity for storing coins. For example, the cashbox can be formed to extend into space behind the coin storage tubes. Also, other coin stores can be used in place of storage tubes such as, for example, stores which dispense change but do not receive coins from the validator. The mechanism or cassette may contain only a cashbox and no other stores.

Various other modifications will also be apparent to the skilled person.

What is claimed is:

1. A coin mechanism comprising coin dispensing means for removing a coin from a coin store for change and a cashbox arranged in use above the coin dispensing means, said cashbox being for storing coins of a plurality of different denominations and for storing coins from a plurality of transactions simultaneously, and wherein said cashbox does not dispense coins as change.

2. A coin mechanism as claimed in claim 1 comprising means for allowing coins to be removed from the cashbox in place within the coin mechanism.

3. A coin mechanism as claimed in claim 2 comprising a coin reject path and wherein coins are removable from the cashbox by way of the coin reject path.

4. A coin mechanism as claimed in claim 2 wherein coins are removable from the cashbox by way of a coin return tray of apparatus housing the coin mechanism.

5. A coin mechanism as claimed in claim 1 wherein the cashbox comprises a door to enable coins to be removed from the cashbox.

6. A coin mechanism as claimed in claim 1 wherein the cashbox is removable from and replaceable in the coin mechanism.

7. A coin mechanism as claimed in claim 1 further comprising at least one additional coin store.

8. A coin mechanism as claimed in claim 7, wherein the additional coin store is for dispensing coins as change.

9. A coin mechanism as claimed in claim 7 wherein the additional coin store is arranged for storing coins of one denomination only.

10. A coin mechanism as claimed in claim 1 wherein the cashbox is in a cassette which is removable from and replaceable in the coin mechanism.

11. A coin mechanism as claimed in claim 1 comprising at least one coin store additional to the cashbox, in which acceptable coins are directed to either an additional coin store or the cashbox.

12. A coin mechanism comprising a cassette which is removable from and replaceable in the coin mechanism, wherein the cassette includes a cashbox and at least one coin store in addition to the cashbox, wherein an additional store is a single denomination store for storing coins of one denomination only.

13. A cassette as claimed in claim 12, wherein said cashbox is for storing coins of a plurality of different denominations and for storing coins from a plurality of transactions simultaneously and wherein said cashbox does not dispense coins as change.

14. A coin mechanism comprising a cassette which is removable from and replaceable in the coin mechanism, wherein the cassette includes a cashbox and at least one coin store in addition to the cashbox, wherein an additional store is for dispensing coins as change.

15. A cashbox as claimed in claim 14, wherein said cashbox is for storing coins of a plurality of different denominations and for storing coins from a plurality of transactions simultaneously and wherein said cashbox does not dispense coins as change.

16. A cassette, for use in a coin mechanism, which is removable from and replaceable in the coin mechanism, wherein the cassette comprises a cashbox and at least one coin store in addition to the cashbox, wherein an additional store is a single denomination store for storing coins of one denomination only.

17. A cashbox as claimed in claim 16, wherein said cashbox is for storing coins of a plurality of different denominations and for storing coins from a plurality of transactions simultaneously and wherein said cashbox does not dispense coins as change.

18. A cassette, for use in a coin mechanism, which is removable from and replaceable in the coin mechanism, wherein the cassette comprises a cashbox and at least one coin store in addition to the cashbox, wherein an additional store is for dispensing coins as change.

19. A cashbox as claimed in claim 18, wherein said cashbox is for storing coins of a plurality of different denominations and for storing coins of a plurality of different denominations and for storing coins from a plurality of transactions simultaneously and wherein said cashbox does not dispense coins as change.

20. A coin mechanism comprising a coin reject path and a cashbox, wherein coins can be removed from the cashbox by way of the coin reject path, said cashbox being for storing coins of a plurality of different denominations and for storing coins from a plurality of transactions simultaneously, and wherein said cashbox does not dispense coins as change.

21. A coin mechanism comprising a cashbox and a coin return tray, wherein coins can be removed from the cashbox by way of the coin return tray, said cashbox being for storing coins of a plurality of different denominations and for storing coins from a plurality of transactions simultaneously, and wherein said cashbox does not dispense coins as change.

22. A method of adapting a coin mechanism or a cassette for use in a coin mechanism including single denomination stores for dispensing coins, the method comprising replacing one or more said stores with a cashbox, said cashbox being for storing coins of a plurality of different denominations and for storing coins from a plurality of transactions simultaneously, and wherein said cashbox does not dispense coins as change.

* * * * *